US011368780B1

(12) United States Patent
Kong

(10) Patent No.: US 11,368,780 B1
(45) Date of Patent: Jun. 21, 2022

(54) BONE CONDUCTION EARPHONE

(71) Applicant: SHENZHEN XINWANHONG TECHNOLOGY CO., LTD., Shenzhen (CN)

(72) Inventor: Yuliang Kong, Xingtai (CN)

(73) Assignee: SHENZHEN XINWANHONG TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/543,677

(22) Filed: Dec. 6, 2021

(51) Int. Cl.
*H04R 25/00* (2006.01)
*H04R 1/10* (2006.01)

(52) U.S. Cl.
CPC ..... *H04R 1/105* (2013.01); *H04R 1/1008* (2013.01); *H04R 2201/109* (2013.01); *H04R 2420/05* (2013.01); *H04R 2460/13* (2013.01)

(58) Field of Classification Search
CPC H04R 1/105; H04R 1/1008; H04R 2201/109; H04R 2420/05; H04R 2460/13
USPC ..... 381/151
See application file for complete search history.

(56) References Cited

FOREIGN PATENT DOCUMENTS

CN 211702348 U * 10/2020
CN 214544731 U * 10/2021

* cited by examiner

*Primary Examiner* — Phylesha Dabney

(57) ABSTRACT

A bone conduction earphone includes an earphone body configured to attach to an auricle of a human body and transmit an audio vibration signal and an ear hook configured to hook on the auricle. A first end of the ear hook is fixedly connected with the earphone body. A second end of the ear hook extends between the auricle and a head of the human body. The second end of the ear hook extends along the auricle and laterally deviates from the earphone body. In a natural state, a lateral distance between the earphone body and an extending end of the ear hook is less than a lateral distance from a front surface of the auricle to a back surface of the auricle. When the bone conduction earphone is worn, the earphone body and the ear hook clamp the auricle.

15 Claims, 3 Drawing Sheets

BONE CONDUCTION EARPHONE

TECHNICAL FIELD

The present disclosure relates to a field of earphones, and in particular to a bone conduction earphone.

BACKGROUND

Bone conduction is a way of sound conduction, which converts sound into mechanical vibrations of different frequencies, and transmits sound waves through human skull, bone labyrinth, inner ear lymph, spiral organs, and auditory center.

With development of technology, earphones have become essential equipment for people. However, with improvement of people's living standards, there is a greater pursuit of wearing earphones. A left earphone and a right earphone of conventional bone conduction earphones are connected by a wire and the wire is dragged to the hair or neck of a back portion of the head. The left earphone and the right earphone are simply hooked on the auricles, which affects stability of wearing.

SUMMARY

An object of the present disclosure is to provide a bone conduction earphone to solve a technical problem of poor wearing stability of conventional bone conduction earphones in the prior art.

To achieve the above object, the present disclosure provides a bone conduction earphone. The bone conduction earphone comprises an earphone body configured to attach to an auricle of a human body and transmit an audio vibration signal and an ear hook configured to hook on the auricle.

A first end of the ear hook is fixedly connected with the earphone body. A second end of the ear hook extends between the auricle and a head of the human body. The second end of the ear hook extends along the auricle and laterally deviates from the earphone body. In a natural state, a lateral distance between the earphone body and an extending end of the ear hook is less than a lateral distance from a front surface of the auricle to a back surface of the auricle. When the bone conduction earphone is worn, the earphone body and the ear hook clamp the auricle.

Furthermore, a deviation angle of the extending end of the ear hook relative to the earphone body in a vertical direction is a and $-30° \leq \alpha \leq 45°$.

Furthermore, the ear hook comprises a main hook body and a power supply component. A first end of the main hook body is fixedly connected with the earphone body. A second end of the main hook body is connected with the power supply component. The power supply component is electrically connected with the earphone body.

Furthermore, the main hook body is arc-shaped and fits a shape of the auricle.

Furthermore, the main hook body is made of elastic plastic material.

Furthermore, the power supply component comprises a housing and a power module arranged in the housing. The power module is electrically connected with the earphone body. The main hook body is detachably connected with the housing.

Furthermore, the main hook body comprises a hook portion, a first connecting end extending from one end of the hook portion, and a plurality of clamping protrusions protruding from a periphery of the first connecting end. The housing comprises an inserting cavity communicated with an interior of the housing. An inner cavity wall of the inserting cavity is provided with a plurality of clamping grooves. The first connecting end is inserted into the inserting cavity. Each of the plurality of clamping protrusions is clamped in a corresponding clamping groove.

Furthermore, an outer contour of a cross section of the first connecting end prevents the first connecting end from rotating relative to the inserting cavity. The first connecting end is matched with the inserting cavity of the housing.

Furthermore, the power module is connected with the earphone body by a conductive wire. The conductive wire is embedded in the main hook body along an extending direction of the main hook body; or the main hook body comprises a wire passage and an extending direction of the wire passage is same as the extending direction of the main hook body. The conductive wire passes through the wire passage.

Furthermore, the main hook body further comprises a second connecting end extending from one end of the hook portion opposite to the first connecting end. The earphone body comprises a connecting cavity communicated with an interior of the earphone body. The second connecting end is inserted into the connecting cavity. The second connecting end is in interference fit with, is glued together with, or is clamped with the connecting cavity.

Furthermore, at least one positioning bar is protruding from a sidewall of the second connecting end. An extending direction of each positioning bar is same as an extending direction of the second connecting end. An inner cavity wall of the connecting cavity is provided with at least one positioning groove. When the second connecting end is inserted into the connecting cavity, each positioning bars is inserted into a corresponding positioning groove and slides along the corresponding positioning groove.

Furthermore, the earphone body comprises an earphone shell, a main control circuit board, a bone conduction speaker connected with the main control circuit board, and a microphone connected with the main control circuit board. The main control circuit board is arranged in the earphone shell and is electrically connected with the power supply component. The bone conduction speaker directly faces the auricle and fits with the auricle.

Furthermore, the earphone body further comprises two charging posts. A first end of each of the charging posts is arranged on the main control circuit board. A second end of each of the charging posts is exposed from the earphone shell.

Furthermore, the earphone body further comprises an indicator light and a positioning sensor detecting a distance between the earphone body and a control device. Both of the indicator light and the positioning sensor are connected with the main control circuit board. The indicator light lights up when the distance detected by the positioning sensor exceeds a predetermined value. The indicator light remains off when the distance detected by the positioning sensor does not exceed the predetermined value.

Furthermore, a soft rubber pad is arranged on a surface of the housing facing the auricle, or the housing is made of soft rubber material.

In the present disclosure, the bone conduction earphone comprises the earphone body and the ear hook. The earphone body is attached to the auricle and is configured to transmit audio vibration signals. The first end of the ear hook is fixedly connected with the earphone body. The second end of the ear hook extends between the auricle and the head of the human body. The second end of the ear hook extends along the auricle and laterally deviates from the earphone body. When the bone conduction earphone is in the natural state, the lateral distance between the earphone body and the extending end of the ear hook is less than the lateral distance from the front surface of the auricle to the back surface of the auricle. When the bone conduction earphone is worn, the earphone body and the ear hook clamp the auricle. In this way, the earphone body is attached to the auricle and the ear hook is hooked on the auricle. Due to an overall shape of the ear hook, the earphone body and the ear hook clamp the auricle when wearing the bone conduction earphone, which improve overall stability of wearing, and on the other hand, improves fit of the earphone body, Thus, overall sound quality and sound transmission of the bone conduction earphone is improved and user's experience of using the bone conduction earphone is enhanced.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor. In the drawing.

In the drawings.

| | | | |
|---|---|---|---|
| Bone conduction earphone | 1 | Earphone body | 100 |
| Ear hook | 200 | Main hook body | 210 |
| Power supply component | 220 | Housing | 221 |
| Hook portion | 211 | First connecting end | 212 |
| Clamping protrusion | 213 | Inserting cavity | 201 |
| Clamping groove | 202 | Second connecting end | 214 |
| Connecting cavity | 101 | Positioning bar | 215 |
| Positioning groove | 102 | Earphone shell | 110 |
| Charging post | 120 | Indicator light | 130 |

DETAILED DESCRIPTION

In order to make the purpose, technical solutions, and advantages of the present disclosure clear, the following further describes the present disclosure in detail with reference to accompanying drawings and embodiments.

It should be noted that when one component is referred to as being "fixed on" or "disposed on" another component, it can be directly disposed on the other component or it may be indirectly fixed or disposed on the other component through a third component. When one component is said to be "connected to" another component, it may be directly connected to the other component or it may be indirectly connected to the other component through a third component.

It should be understood that terms such as "central", "horizontal", "upper", "lower", "left", "right", "vertical", "horizontal", "top", "bottom", "inner", "outer", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

In addition, terms such as "first" and "second" are only used for the purpose of description, rather than being understood to indicate or imply relative importance or hint the number of indicated technical features. Thus, the feature limited by "first" and "second" can explicitly or impliedly include one or more features. In the description of the present disclosure, the meaning of "a plurality of" is two or more unless otherwise specified.

Figure 1:
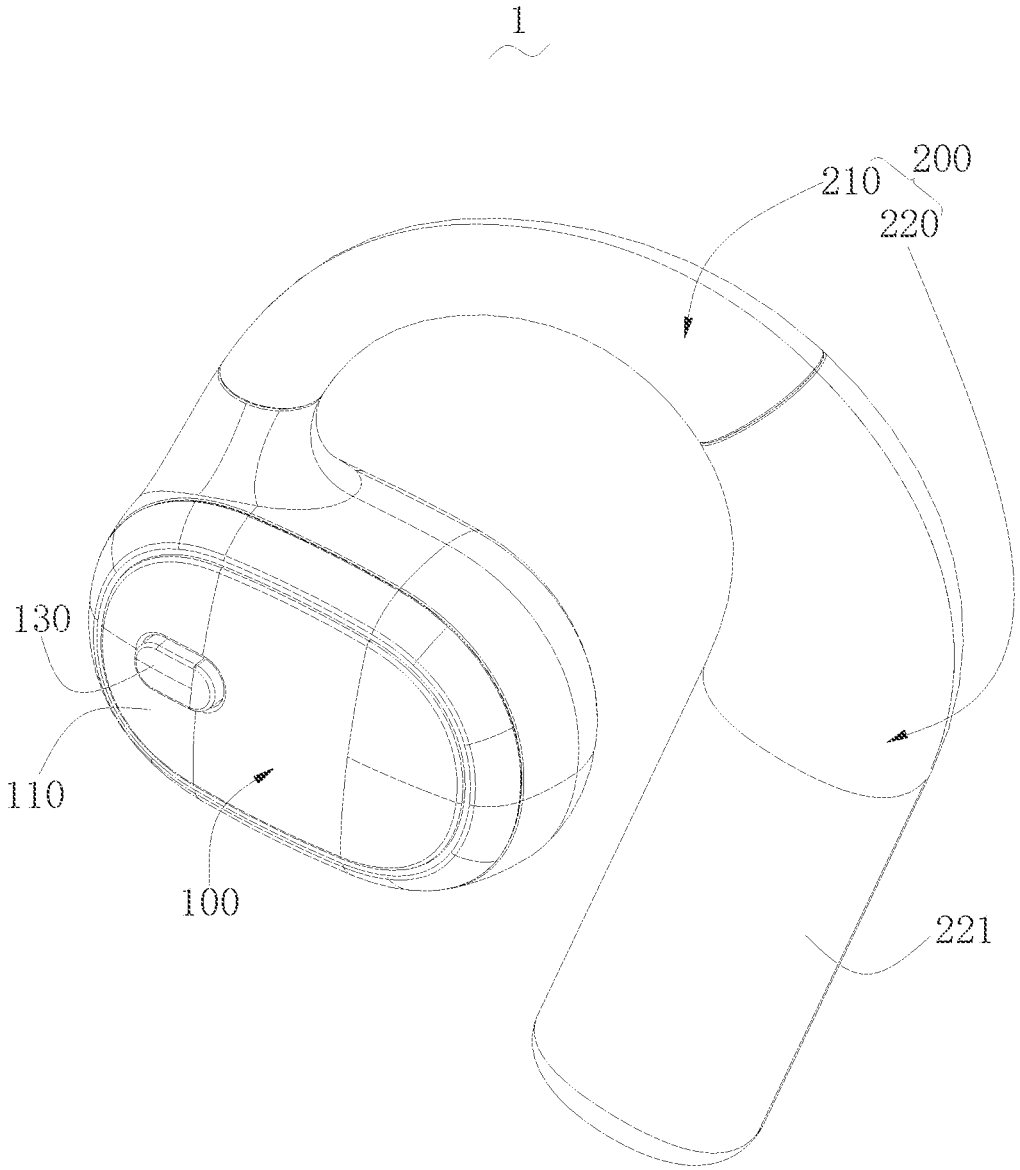
FIG. 1 is a perspective schematic diagram of a bone conduction earphone according to one embodiment of the present disclosure.
Figure 2:
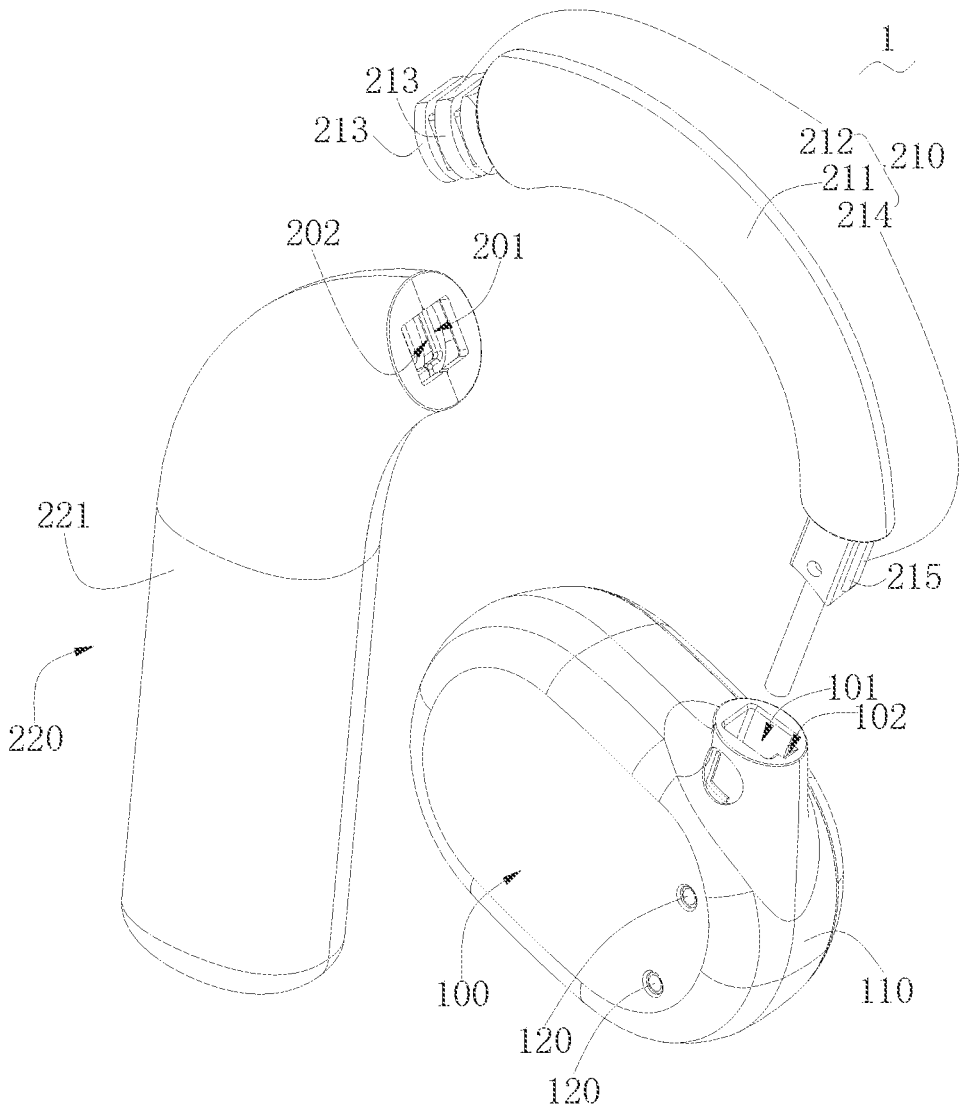
FIG. 2 is an exploded perspective schematic diagram of a bone conduction earphone according to one embodiment of the present disclosure.
Figure 3:
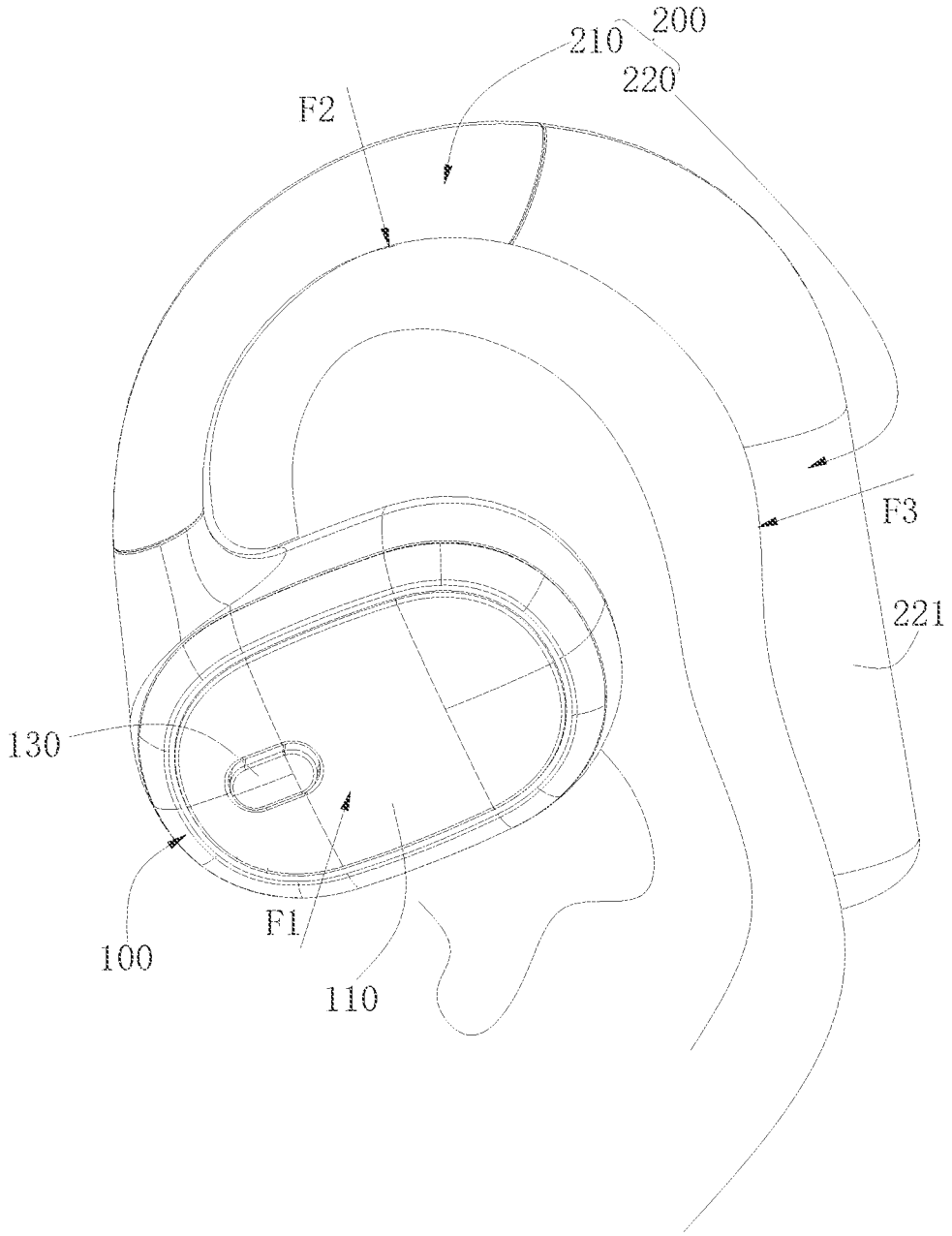
FIG. 3 is a perspective schematic diagram of a bone conduction earphone according to one embodiment of the present disclosure.

As shown in FIGS. 1-3, in one embodiment, the present disclosure provides a bone conduction earphone 1. The bone conduction earphone 1 comprises an earphone body 100 and an ear hook 200. The earphone body 100 is configured to attach to an auricle of a human body and is configured to transmit an audio vibration signal. A first end of the ear hook 200 is fixedly connected with the earphone body 100. A second end of the ear hook 200 extends between the auricle and a head of the human body. The second end of the ear hook 200 extends along the auricle and laterally deviates from the earphone body 100. In a natural state, a lateral distance between the earphone body 100 and an extending end of the ear hook 200 is less than a lateral distance from a front surface of the auricle (the front surface toward a front side of the human body) to a back surface of the auricle (the back surface face the head). When wearing the bone conduction earphone, the earphone body 100 and the ear hook 200 clamp the auricle.

In the embodiment, the bone conduction earphone 1 comprises the earphone body 100 and the ear hook 200. The earphone body 100 is attached to the auricle and is configured to transmit audio vibration signals. The ear kook 200 is hooked on the auricle. The first end of the ear hook 200 is fixedly connected with the earphone body 100. The second end of the ear hook 200 extends between the auricle and the head of the human body. The second end of the ear hook 200 extends along the auricle and laterally deviates from the earphone body. When the bone conduction earphone is in the natural state, the lateral distance between the earphone body 100 and the extending end of the ear hook 200 is less than the lateral distance from the front surface of the auricle to the back surface of the auricle. When worn, the earphone body 100 and the ear hook 200 clamp the auricle. In this way, the earphone body 100 is attached to the auricle and the ear hook is hooked on the auricle. Due to an overall shape of the ear hook 200, the earphone body 100 and the ear hook 200 clamp the auricle when wearing the bone conduction earphone, which in one hand improve overall stability of wearing and without a need for a wire to connect a left earphone and a right earphone. On the other hand, by clamping manner of the ear hook and the earphone body, fit of the earphone body 100 is effectively improved, thereby improving overall sound quality and sound transmission of the bone conduction earphone 1 and enhancing user's experience of using the bone conduction earphone 1.

As shown in FIG. 3, FIG. 3 is a schematic diagram of the bone conduction earphone 1 being worn on the auricle. In the embodiment, the earphone body 100 applies a force F1 to the auricle. A direction of the force F1 is perpendicular to a front side of the auricle, and points to a direction of the head. The ear hook 200 is hooked on the auricle and is in contact with the auricle. The ear hook 200 applies a force of F2 to the auricle, the force F2 is directed downward or diagonally forward and downward. An extending end of the ear hook 200 abuts a back side of the auricle and applies a force F3 directed forward. The bone conduction earphone 1 is clamped on the auricle under action of forces F1, F2, and F3 to improve the overall wearing stability. The bone conduction earphone discards a method that the conventional earphones of the left earphone and the right earphone connected by a connecting wire, and is convenient to wear while realizing wireless connection.

The bone conduction earphone 1 is a wireless earphone, and a built-in system is True Wireless Stereo (TWS) earphone technology. TWS technology is also based on development of BLUETOOTH chip technology. According to its working principle, it means that a mobile phone is first connected to a main earphone, and then the main earphone is quickly connected to a secondary earphone wirelessly, realizing the true wireless separation of a BLUETOOTH left channel and a BLUETOOTH right channel.

The TWS BLUETOOTH earphones does not require a wire for connection, which gets rid of the shackles of traditional earphones. The left earphone and the right earphone form a stereo system through BLUETOOTH, so that listening, calling and wearing of the TWS BLUETOOTH earphones are improved. If professional acoustic pickup technology, intelligent noise reduction, and AI algorithm noise reduction technology, etc. are applied to the TWS BLUETOOTH earphones, the user realizes a perfect sound experience, and the user can wear the TWS BLUETOOTH earphones for voice calls, video calls, music enjoyment, mountain climbing and running, safe driving, etc.

Optionally, as shown in FIGS. 1-3, a deviation angle of the extending end of the ear hook 200 relative to the earphone body in a vertical direction is a and $-30° \leq \alpha \leq 45°$. It is understood that the extending end of the ear hook 200 is deviates toward the head or away from the head, which is mainly determined by a shape of the auricle of the user. Finally, the ear hook 200 clamps the auricle to achieve fixation effect of the bone conduction earphone 1.

In the embodiment, the deviation angle $\alpha$ is the deviation angle between the extending end of the ear hook 200 and the earphone body 100 when the bone conduction earphone has no external force and the lateral distance between the earphone body 100 and the extending end of the ear hook 200 is less than the lateral distance from the front surface of the auricle to the back surface of the auricle. When the bone conduction earphone is worn, the lateral distance between the earphone body 100 and the extending end of the ear hook 200 is stretched to a thickness of the auricle. Namely, the bone conduction earphone 1 has an elastic restoring force to restore to an original state. Under action of the elastic restoring force, the bone conduction earphone 1 generates a clamping force configured to clamp the auricle, so the bone conduction earphone 1 is fixed on the auricle, and the wearing stability is improved.

In the embodiment, the deviation angle between the ear hook 200 and the earphone body 100 is adjusted according to the needs of different users, so the earphone body 100 and the ear hook 200 fit the auricle more closely. That is, the bone conduction earphone 1 has a good fit effect to the ear, which avoids personal differences affecting the user experience, improves the user's wearing comfort, and achieves good sound transmission effects due to high fit of the bone conduction earphone 1 to the ear.

When worn, the earphone body 100 fits the auricle without plugging into the ears, which well protect hearing. The sound is transmitted through vibration of the earphone body 100, so the sound transmission is efficient and the transmission effect is good. When in use, the user wears two bone conduction earphones of the present disclosure, a control device is BLUETOOTH connected with the two bone conduction earphones to control the two bone conduction earphones. There is no connecting wire between the two bone conduction earphones. Of course, a single bone conduction earphone can be used normally, which increases the freedom of use.

As shown in FIGS. 1-3, furthermore, the ear hook 200 comprises a main hook body 210 and a power supply component 220. A first end of the main hook body 210 is fixedly connected with the earphone body 100. A second end of the main hook body 210 is connected with the power supply component 220. The power supply component 220 is electrically connected with the earphone body 100 to provide power to the earphone body 100.

In the embodiment, the power supply component 220 is arranged between the head and the auricle when worn, which effectively improves an overall aesthetics of the bone conduction earphone.

As shown in FIGS. 1-3, optionally, the main hook body 210 is arc-shaped and fits a shape of the auricle. The main hook body 210 is hooked one the auricle. The shape of the main hook body 210 fits the shape of the auricle, which effectively improves fit between the main hook body 210 and the auricle. In the embodiment, the main hook body 210 is hooked on the auricle, and the force applied to the auricle is defined as F1.

Furthermore, as shown in FIGS. 1-3, the main hook body 210 is made of elastic plastic material. During production, the elastic plastic material is directly made into the main hook body with a certain elastic clamping force according to a predetermined angle. The main hook body 210 has a certain flexibility, and is fine-tuned at a certain angle to meet the needs of different users. It is understood that the predetermined angle of the main hook body is the deviation angle $\alpha$ between the extending end of the ear hook 200 and the earphone body 100 when the bone conduction earphone is not used and has no external force applied in it, and the lateral distance between the earphone body 100 and the extending end of the ear hook 200 is less than the lateral distance from the front surface of the auricle to the back surface of the auricle. When the bone conduction earphone is worn, the lateral distance between the earphone body 100 and the extending end of the ear hook 200 is stretched to the thickness of the auricle. Namely, the bone conduction earphone 1 has the elastic restoring force to restore to an original state. Under the action of the elastic restoring force, the bone conduction earphone 1 generates the clamping force configured to clamp the auricle, so the bone conduction earphone 1 is fixed on the auricle, and the wearing stability is improved.

Furthermore, as shown in FIGS. 1-3, the power supply component 220 comprises a housing 221 and a power module (not shown in the drawings) arranged in the housing 221. The power module is electrically connected with the earphone body. The main hook body is detachably connected with the housing 221, which is convenient for assembling and disassembling, and improves assembling and disassembling efficiency.

Optionally, as shown in FIGS. 1-3, the main hook body 210 comprises a hook portion 211, a first connecting end 212 extending from one end of the hook portion 211, and a plurality of clamping protrusions 213 protruding from a periphery of the first connecting end 212. The housing 221 comprises an inserting cavity 201 communicated with an interior of the housing 221. An inner cavity wall of the inserting cavity 201 is provided with a plurality of clamping grooves 202. The first connecting end 212 is inserted into the inserting cavity 201. Each of the plurality of clamping protrusions 213 is clamped in a corresponding clamping groove 202 to realize detachable connection between the first connecting end 212 and the housing 221.

In the embodiment, an outer contour of a cross section of the first connecting end 212 is square. The plurality of clamping protrusions 213 are evenly arranged on two opposite surfaces of the first connecting end 212.

In the embodiment, a connecting end of the housing 221 connected with the first connecting end 212 is arc-shaped. A junction of the housing 221 with the main hook body 210 is smoothly transitioned, which further improves the wearing comfort.

Optionally, as shown in FIGS. 1-3, an outer contour of a cross section of the first connecting end 212 prevents the first connecting end 212 from rotating relative to the inserting cavity 201. The first connecting end 212 is matched with the inserting cavity 201 of the housing 221.

In the embodiment, the outer contour of the cross section of the first connecting end 212 is non-circular, and is selected from an elliptical outer contour, a polygonal outer contour, a long elliptical outer contour, a fan-shaped outer contour, etc., as long as the first connecting end 212 is unable to rotate relative to a circumferential direction of the inserting cavity 201. Such an arrangement of the first connecting end 212 effectively prevents the main hook body 210 from shifting in the circumferential direction, and improves service life and wearing comfort of the bone conduction earphone 1.

Furthermore, as shown in FIGS. 1-3, the power module is connected with the earphone body 100 by a conductive wire. The conductive wire is embedded in the main hook body 210 along an extending direction of the main hook body 210; or the main hook body 210 comprises a wire passage and an extending direction of the wire passage is same as the extending direction of the main hook body 210. The conductive wire passes through the wire passage.

Furthermore, as shown in FIGS. 1-3, the main hook body 210 further comprises a second connecting end 214 extending from one end of the hook portion 211 opposite to the first connecting end 212. The earphone body 100 comprises a connecting cavity 101 communicated with an interior of the earphone body 100. The second connecting end 214 is inserted into the connecting cavity 101. The second connecting end is in interference fit with, is glued together with, or is clamped with the connecting cavity (through clamping structures such as the clamping protrusions and the clamping grooves of the first connecting end 212 and the inserting cavity 201)

Optionally, as shown in FIGS. 1-3, at least one positioning bar 215 is protruding from a sidewall of the second connecting end 214. An extending direction of each positioning bar 215 is same as an extending direction of the second connecting end 214. An inner cavity wall of the connecting cavity 101 is provided with at least one positioning groove 102. When the second connecting end 214 is inserted into the connecting cavity 101, each positioning bars 215 is inserted into a corresponding positioning groove 102 and slides along the corresponding positioning groove 102. In this way, positioning and installation between the second connecting end 214 and the earphone body 100 is realized, accuracy of the deviation angle of the ear hook 200 is improved, a phenomenon that the deviation angle is too large or too small is avoided, which improve the user's use experience.

Furthermore, as shown in FIGS. 1-3, the earphone body comprises an earphone shell 110, a main control circuit board, a bone conduction speaker connected with the main control circuit board, and a microphone connected with the main control circuit board. The main control circuit board is arranged in the earphone shell 110 and is electrically connected with the power supply component 220. The bone conduction speaker directly faces the auricle and fits with the auricle.

Furthermore, as shown in FIGS. 1-3, the earphone body 100 further comprises two charging posts 120. A first end of each of the charging posts 120 is arranged on the main control circuit board. A second end of each of the charging posts 120 is exposed from the earphone shell 110. When charging, the bone conduction earphone 1 is placed in a charging base having elastic charging needles or elastic charging sheets, and the charging posts 120 elastically contacts the elastic charging needles or the elastic charging sheets to charge the power module. In the embodiment, the power module is a battery.

Furthermore, as shown in FIGS. 1-3, the earphone body 100 further comprises an indicator light 130 and a positioning sensor detecting a distance between the earphone body and a control device. Both of the indicator light 130 and the positioning sensor are connected with the main control circuit board. The indicator light 130 lights up when the distance detected by the positioning sensor exceeds a predetermined value. The indicator light 130 remains off when the distance detected by the positioning sensor does not exceed the predetermined value. The indicator light 130 plays a prompting role. The indicator light 130 extends from the earphone shell 110 and is exposed to an outside. The indicator light 130 is arranged on one side of the earphone body 100 opposite to the auricle. In the embodiment, the control device is a terminal device, such as a mobile phone, a tablet, a computer, and so on.

Optionally, as shown in FIGS. 1-3, a soft rubber pad is arranged on a surface of the housing 221 facing the auricle, or the housing 221 is made of soft rubber material. The soft rubber material can be rubber material, silicone material, etc., which improves the wearing comfort.

The above are only optional embodiments of the present disclosure and are not intended to limit the present disclosure. Any modification, equivalent replacement, and improvement made within the spirit and principle of the present disclosure shall be included in the protection scope of the present disclosure.

What is claimed is:

1. A bone conduction earphone, comprising:

an earphone body configured to attach to an auricle of a human body and configured to transmit an audio vibration signal; and an ear hook configured to hook on the auricle;

wherein a first end of the ear hook is fixedly connected with the earphone body; a second end of the ear hook extends between the auricle and a head of the human body; the second end of the ear hook extends along the auricle and laterally deviates from the earphone body; in a natural state, a lateral distance between the earphone body and the extending end of the ear hook is less than a lateral distance from a front surface of the auricle to a back surface of the auricle; when the bone conduction earphone is worn, the earphone body and the ear hook clamp the auricle;

wherein the ear hook comprises a main hook body; the main hook body comprises a hook portion, a first connecting end extending from one end of the hook portion, and a plurality of clamping protrusions protruding from a periphery of the first connecting end.

2. The bone conduction earphone according to claim 1, wherein a deviation angle of the extending end of the ear hook relative to the earphone body in a vertical direction is a and $-30° \leq \alpha \leq 45°$.

3. The bone conduction earphone according to claim 1, wherein the ear hook further comprises a power supply component; a first end of the main hook body is fixedly connected with the earphone body; a second end of the main hook body is connected with the power supply component; the power supply component is electrically connected with the earphone body.

4. The bone conduction earphone according to claim 3, wherein the main hook body is arc-shaped and fits a shape of the auricle.

5. The bone conduction earphone according to claim 3, wherein the main hook body is made of elastic plastic material.

6. The bone conduction earphone according to claim 3, wherein the power supply component comprises a housing and a power module arranged in the housing; the power module is electrically connected with the earphone body; the main hook body is detachably connected with the housing.

7. The bone conduction earphone according to claim 6, wherein the housing comprises an inserting cavity communicated with an interior of the housing; an inner cavity wall of the inserting cavity is provided with a plurality of clamping grooves; the first connecting end is inserted into the inserting cavity; each of the plurality of clamping protrusions is clamped in a corresponding clamping groove.

8. The bone conduction earphone according to claim 7, wherein an outer contour of a cross section of the first connecting end prevents the first connecting end from rotating relative to the inserting cavity; the first connecting end is matched with the inserting cavity of the housing.

9. The bone conduction earphone according to claim 6, wherein the power module is connected with the earphone body by a conductive wire; the conductive wire is embedded in the main hook body along an extending direction of the main hook body; or the main hook body comprises a wire passage and an extending direction of the wire passage is same as the extending direction of the main hook body; the conductive wire passes through the wire passage.

10. The bone conduction earphone according to claim 8, wherein the main hook body further comprises a second connecting end extending from one end of the hook portion opposite to the first connecting end; the earphone body comprises a connecting cavity communicated with an interior of the earphone body; the second connecting end is inserted into the connecting cavity; the second connecting end is in interference fit with, is glued together with, or is clamped with the connecting cavity.

11. The bone conduction earphone according to claim 10, wherein at least one positioning bar is protruding from a sidewall of the second connecting end; an extending direction of each positioning bar is same as an extending direction of the second connecting end; an inner cavity wall of the connecting cavity is provided with at least one positioning groove; when the second connecting end is inserted into the connecting cavity, each positioning bars is inserted into a corresponding positioning groove and slides along the corresponding positioning groove.

12. The bone conduction earphone according to claim 3, wherein the earphone body comprises an earphone shell, a main control circuit board, a bone conduction speaker connected with the main control circuit board, and a microphone connected with the main control circuit board; the main control circuit board is arranged in the earphone shell and is electrically connected with the power supply component; the bone conduction speaker directly faces the auricle and fits with the auricle.

13. The bone conduction earphone according to claim 12, wherein the earphone body further comprises two charging posts; a first end of each of the charging posts is arranged on the main control circuit board; a second end of each of the charging posts is exposed from the earphone shell.

14. The bone conduction earphone according to claim 12, wherein the earphone body further comprises an indicator light and a positioning sensor detecting a distance between the earphone body and a control device, both of the indicator light and the positioning sensor are connected with the main control circuit board; the indicator light lights up when the distance detected by the positioning sensor exceeds a predetermined value; the indicator light remains off when the distance detected by the positioning sensor does not exceed the predetermined value.

15. The bone conduction earphone according to claim 1, wherein a soft rubber pad is arranged on a surface of the housing facing the auricle, or the housing is made of soft rubber material.

* * * * *